US007959017B2

(12) United States Patent
Gerstner et al.

(10) Patent No.: US 7,959,017 B2
(45) Date of Patent: Jun. 14, 2011

(54) COMPRESSION BIN SYSTEM

(75) Inventors: Robert Gerstner, Sleepy Hollow, NY (US); R. Christopher Kidd, New York, NY (US)

(73) Assignee: Lloyd, Gerstner & Partners, Montvale, NJ (US)

( * ) Notice: Subject to any disclaimer, the term of this patent is extended or adjusted under 35 U.S.C. 154(b) by 666 days.

(21) Appl. No.: 11/453,196

(22) Filed: Jun. 14, 2006

(65) Prior Publication Data

US 2007/0000853 A1 Jan. 4, 2007

Related U.S. Application Data

(60) Provisional application No. 60/690,349, filed on Jun. 14, 2005.

(51) Int. Cl.
*A47G 29/00* (2006.01)

(52) U.S. Cl. ..... 211/84

(58) Field of Classification Search ..... 211/84, 211/194, 183; 220/23.4; 312/108; 206/508, 206/509

See application file for complete search history.

(56) References Cited

U.S. PATENT DOCUMENTS 4,232,916 A * 11/1980 Correia ..... 312/107
4,433,883 A * 2/1984 Boender et al. ..... 312/234.1
4,498,584 A * 2/1985 Newbury ..... 206/510
4,823,955 A * 4/1989 Apps ..... 206/506
4,844,567 A * 7/1989 Chalabian ..... 312/139
4,991,913 A * 2/1991 Roger et al. ..... 312/275
5,035,098 A * 7/1991 Newsom ..... 52/591.2
5,123,533 A * 6/1992 Uitz ..... 206/386
5,246,128 A * 9/1993 Uitz ..... 220/4.28
5,325,975 A * 7/1994 Brown et al. ..... 211/189
5,454,634 A * 10/1995 Herbst et al. ..... 312/108
5,685,439 A * 11/1997 Luenser ..... 211/183
5,699,925 A * 12/1997 Petruzzi ..... 220/4.27
5,779,035 A * 7/1998 Marrelli et al. ..... 206/233
5,890,613 A * 4/1999 Williams ..... 220/23.4
6,077,019 A * 6/2000 Corcoran ..... 414/281
6,230,632 B1 * 5/2001 Moore ..... 108/180
6,294,762 B1 * 9/2001 Faries et al. ..... 219/400
6,360,884 B1 * 3/2002 Smith et al. ..... 206/209.1
6,467,635 B1 * 10/2002 McComb et al. ..... 211/85.16
6,719,161 B1 * 4/2004 Craig ..... 220/23.4
6,726,034 B2 * 4/2004 Holbrook et al. ..... 211/87.01
6,988,630 B2 * 1/2006 Matsumoto ..... 220/254.4
7,219,969 B2 * 5/2007 Bezzubov ..... 312/107
2001/0042743 A1 * 11/2001 Faries et al. ..... 219/400
2004/0007546 A1 * 1/2004 Stinnett et al. ..... 211/59.2
2006/0206354 A1 * 9/2006 Mallett et al. ..... 705/1
2007/0144994 A1 * 6/2007 Tew ..... 211/189
2009/0039040 A1 * 2/2009 Johnson et al. ..... 211/120

* cited by examiner

*Primary Examiner* — Sarah Purol

(74) *Attorney, Agent, or Firm* — Cohen Pontani Lieberman & Pavane LLP

(57) ABSTRACT

A bin system includes a plurality of bins arranged in stacks, wherein each of the bins in a stack includes a first element which interlocks with a second element in a lower bin in a stack of bins. The interlock holds the upper bin in a defined position on the lower bin. The first element includes a projection and the second element includes a lateral recess in a side wall of the bin. The system further includes two cross beams for supporting the stacks of bins, wherein the first element of the lowermost bin of a stack of bins is received between the two cross beams. The first element may comprise at least one additional projection arranged to engage an inner side of the side wall for additional support. The interlock between the first and second elements provides a self stacking function in that the interlock retains the upper bin on the lower bin.

29 Claims, 9 Drawing Sheets

COMPRESSION BIN SYSTEM

RELATED APPLICATIONS

This application claims priority from U.S. Provisional Patent Application Ser. No. 60/690,349 which was filed on Jun. 14, 2005.

BACKGROUND OF THE INVENTION

1. Field of the Invention

The present invention relates to a bin system for holding and presenting products for sale and a bin for use in the bin system.

2. Description of the Related Art

In large scale home improvement stores, for example, products are presented in racks which are made of vertical posts and shelves. Hardware products, such as hinges, handles, nuts, bolts, etc. are typically presented in rows of open bins which rest next to each other on shelves. As customers peruse the various choices of items, a customer may pick up a first item and hold onto it until finding a second more suitable item. In this case, the customer may put the first item back into the wrong bin because the customer does not want to spend the time to place the first item back into the correct bin. This is referred to as contamination. Furthermore, the rows of bins include wasted vertical space because each row of bins must be held by a shelf.

SUMMARY OF THE INVENTION

An object of the present invention is to provide a bin system which reduces contamination of products and which reduces space required for product merchandising and a bin for use in the bin system.

The object is met by a bin for holding products and interlocking with another bin. The bin includes a housing having a front end, a rear end, a top and a bottom, and including a bottom section, side walls, and a rear wall defining a space for holding products. The housing has first interlocking means in the bottom section and second interlocking means on a top of at least one of the sidewalls corresponding to the first interlocking means. A door is pivotably arranged at the front end of the housing and is pivotal between a fully open position providing access to the space from the front end and a fully closed position preventing access to the space through the front end. A spring arranged between the door and the housing is dimensioned such that an urgency of the spring resiliently holds the door in the fully closed position. The second interlocking means is capable of receiving the first interlocking means such that the bin is capable of interlockedly receiving another bin from above, when the another bin has the first interlocking means.

The spring is also arranged and dimensioned for resiliently holding the door in the fully open position. Furthermore, the greatest extension of the spring occurs between the fully open position and the fully closed position. The door comprises spring enclosure panels for preventing access to the spring from the front end of the housing when the door is open.

The first interlocking means comprises a first projection extending downward from each lateral side of the bottom section and the second interlocking means comprises a recess in a top of each of the sidewalls. The bin further comprises stops connected to an inner side of the sidewalls, extending upward and defining inner sides of the recesses. The stops may comprise ribs extending substantially vertically on the inner sides of the sidewalls. Additional projections may be arranged rearward of each first projection and inwardly offset from the sidewalls such that the additional projections interact with inner sides of the another bin when the another bin is arranged below the bin.

The bin may further comprise third interlocking means on one of the sidewalls and fourth interlocking means on the other one of the sidewalls, the fourth interlocking means capable of engaging the third interlocking means of another bin when the another bin is laterally adjacent the bin. A boss may further be arranged on the other one of the sidewalls and a further recess on the one of said sidewalls, wherein an interaction between the boss and the further recess of the another bin when the third and fourth interlocking means are engaged preventing release of the another bin from the bin.

A sample of the product in said bin is connected to a front of said door. The bin may further comprise a product control panel dividing the space into two spaces. The product control panel is movably arranged in a longitudinal track defined in the bottom section of the housing for changing a size of the usable space between the door and the product control panel.

The object is also met by a bin system including a plurality of bins arranged in stacks, wherein each of the bins in a stack includes a first element which interlocks with a second element in a lower bin in a stack of bins. The interlock holds the upper bin in a defined position on the lower bin. The first element may comprise a projection and the second element may comprise a lateral recess in a side wall of the bin. The system further includes two cross beams for supporting the stacks of bins, wherein the first element of the lowermost bin of a stack of bins is received between the two cross beams. The first element may comprise at least one additional projection arranged to engage an inner side of the side wall for additional support. The interlock between the first and second elements provides a self stacking function in that the interlock retains the upper bin on the lower bin.

Each bin may further comprise a retaining interface which is received in a recess or slot in a laterally adjacent bin. The retaining interface holds adjacent columns of stacked bins together.

Each bin may also include a pivotable door having a front panel and two side panels. Each of the side panels may include a groove engaging a retainer on the bin such that when the door is pivoted to a fully open position, the retainer abuts and end of the groove, preventing further movement of the door in the open position. The door may be connected to the bin using an offset spring such that the urgency of the spring urges the door towards the closed position when the door is in the closed position and the urgency of the spring urges the door toward the open position when the door in the fully open position. Furthermore, the door may be designed of structurally weaker material than the bin so that any breakage occurs at the door, which may be easily replaced. Instead of structurally weaker material, the connection of the door to the hinge may be made weaker than that of the bin to ensure that the connection to the door fails before the connection to the bin.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
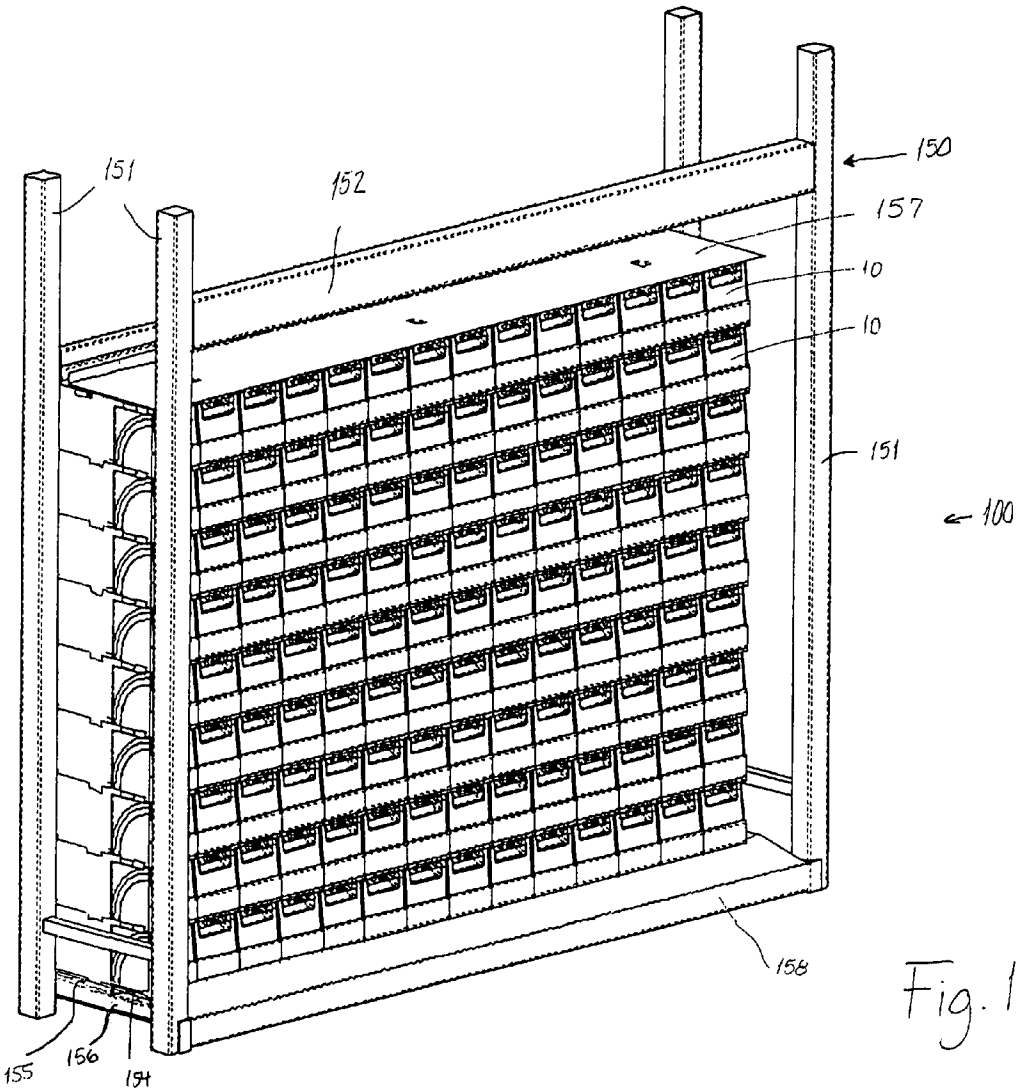
FIG. 1 is a perspective view of a bin system according to an embodiment of the present invention.
Figure 2:
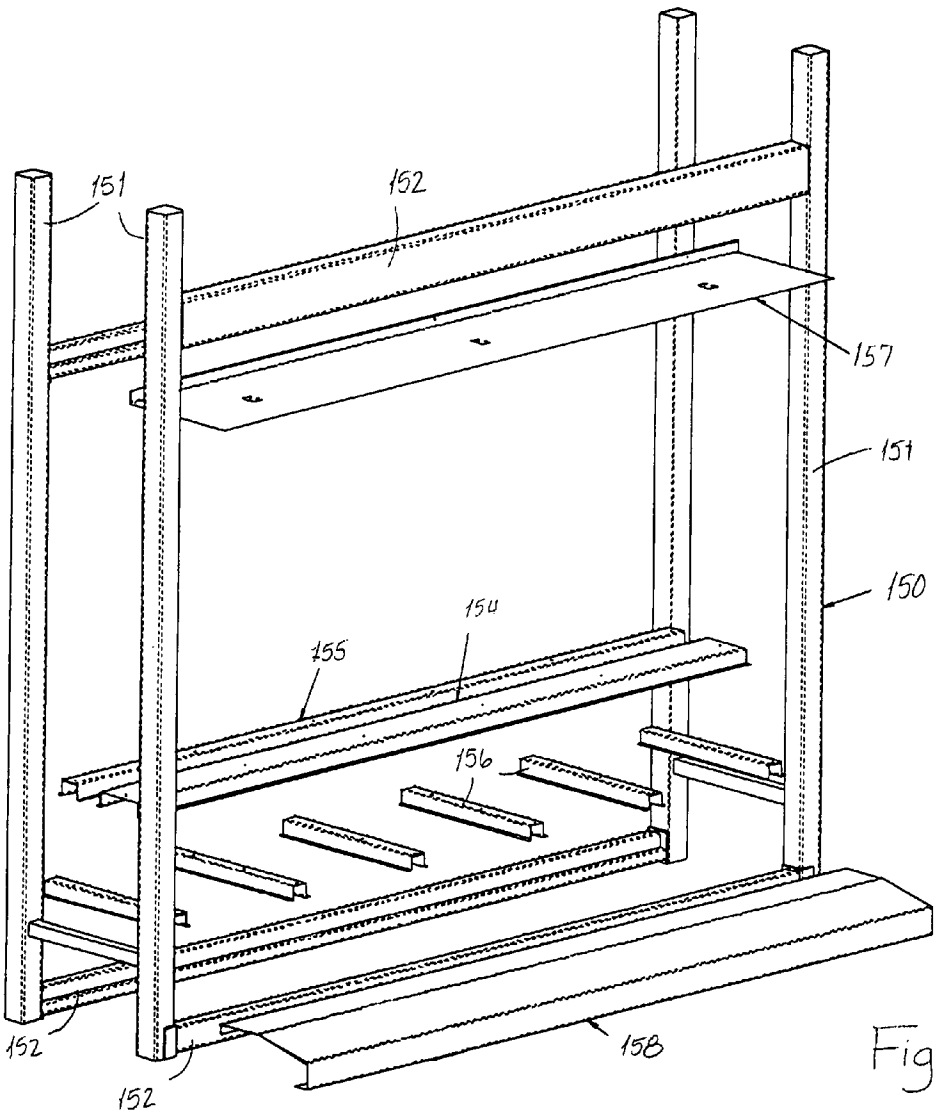
FIG. 2 is a perspective view of the components supporting the bin system of FIG. 1.

FIG. 1 shows an embodiment of a bin system 100 in the installed state. The bin system 100 includes a plurality of bins 10 which are arranged in an array of columns and rows. As shown in FIGS. 1 and 2, the array of bins may be arranged in a rack 150 which is typically an existing fixture in large scale home improvement stores. The rack 150 includes vertical posts 151 and crossbeams 152. For supporting the plurality of bins 10, a pair of crossbeams, i.e., a front crossbeam 154 and a rear crossbeam 155, are arranged on a plurality of crossbeam supports 156. The crossbeams 154, 155 are preferably hat rails, which are referred to as such due to their cross-sectional shape. A bin cover panel 157 may be arranged over the top row of bins 10. An apron 158 may be arranged at the front crossbeam 154 to cover the front crossbeam 154 and crossbeam supports 156. The apron 158 improves the appearance of the bin system and also provides a safety function by preventing customer shoes or garbage from entering into the space between the first row of bins 10 and the floor. Instead of being arranged in a rack 150, the bin system may be arranged as a free-standing array of bins 10. In this embodiment, the crossbeams 154, 155 and crossbeam supports 156 are anchored directly on the floor. The cross beams 154, 155 and beam supports 156 are preferably made of a metal or metal alloy such as for example, steel, aluminum, or alloys thereof. Alternatively, the crossbeams 154, 155, and cross beam supports 156 may consist of any materials known or hereafter developed that are suitable for the intended purpose of supporting the bins.

Figure 3:
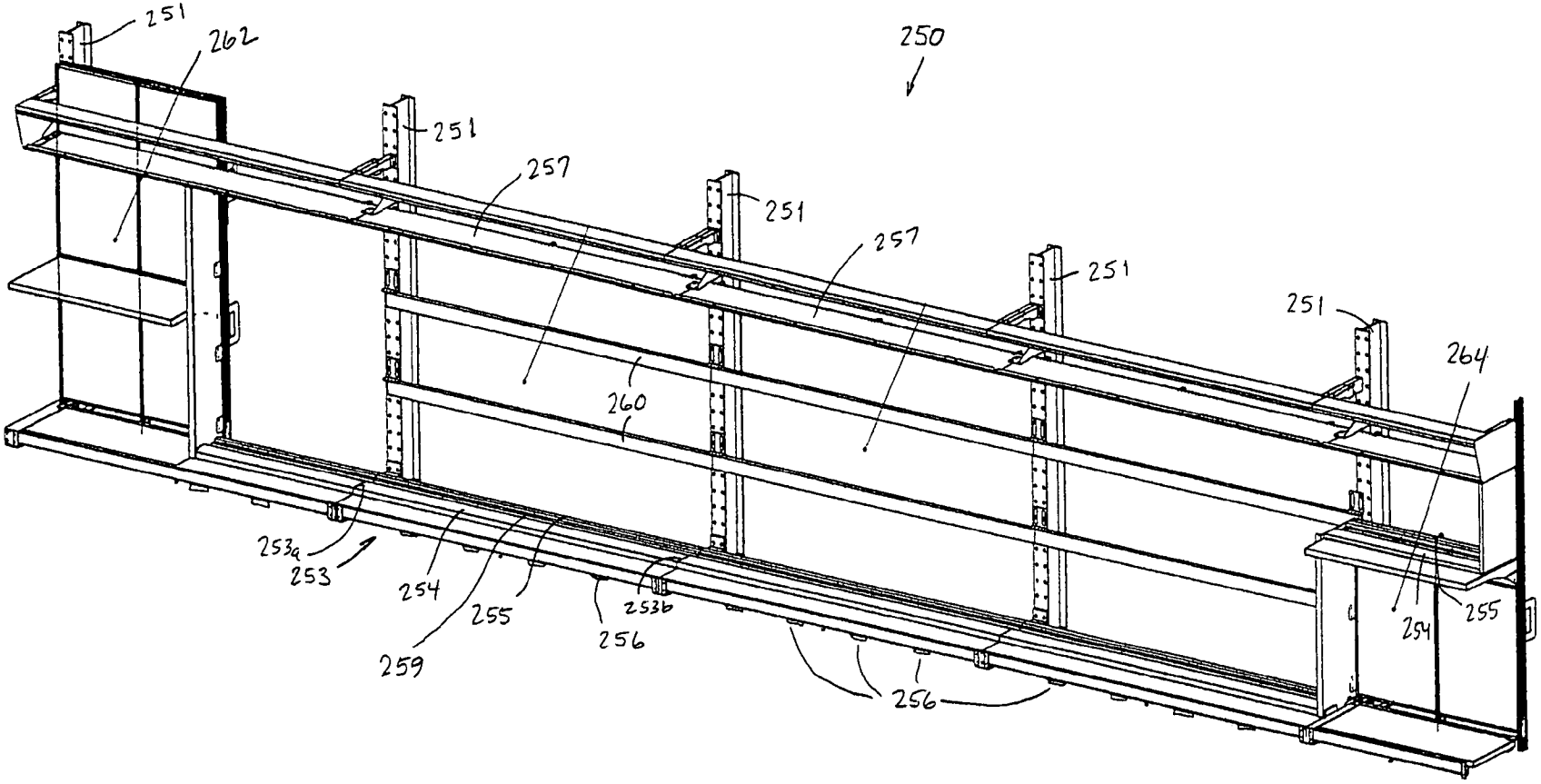
FIG. 3 is a perspective view of a rack for the bin system according to a further embodiment.

Instead of rack 150, the bins 10 may alternatively by arranged in a rack 250 shown in FIG. 3. Rack 250 includes one row of vertical posts 251 anchored in the floor. The vertical posts 251 may be made of steel, aluminum, or alloys thereof. The posts may alternatively be made of other materials such as wood or other known or hereafter developed materials. As explained below, the vertical posts 251 do not support the weight of the bins 10. Rather, they provide a structure in which the bins may be arranged. A support 253 arranged on the floor supports the bins and has two ends 253*a*, 253*b* attached to two of the vertical posts 251. The support 253 include crossbeams 254, 255 and crossbeam supports 256 similar to the crossbeams 154, 155 and crossbeam supports 156 of the previous embodiment. The spaces between the crossbeams 254, 255 form longitudinal channels 259 in which projections of the bins may be received, as described in more detail below. The cross beam supports 256 may be connected, i.e., anchored, to the vertical posts 251 and/or the floor. The support 253 is preferably made of a metal or metal alloy such as for example, steel, aluminum, or alloys thereof. The support 253 may alternatively consist of any other materials known or hereafter developed that are suitable for the intended purpose of supporting the bins 10.

As shown in FIG. 3, a backing support 260 may be arranged between two adjacent vertical posts 251 to provide additional support. A bin cover panel 257 is arranged over the top row of bins. This serves two purposes: it prevents debris or other unwanted items from falling into the bins and helps stabilize the top of the stacks of bins. The bin cover panel 257 is connected to the vertical posts 251 using mechanical fasteners such as, for example, threaded bolts. Although threaded fasteners are used in the preferred embodiment, any known or hereafter developed fastening means may be used to connect the bin cover panel 257 to the vertical posts 251. As further shown in FIG. 3, the rack 250 may incorporate further sections 262, 264 for holding other types of products displays. As shown above section 264, the crossbeams 254, 255 may be arranged above the floor with bins stacked above a further space for other displays.

Figure 4:
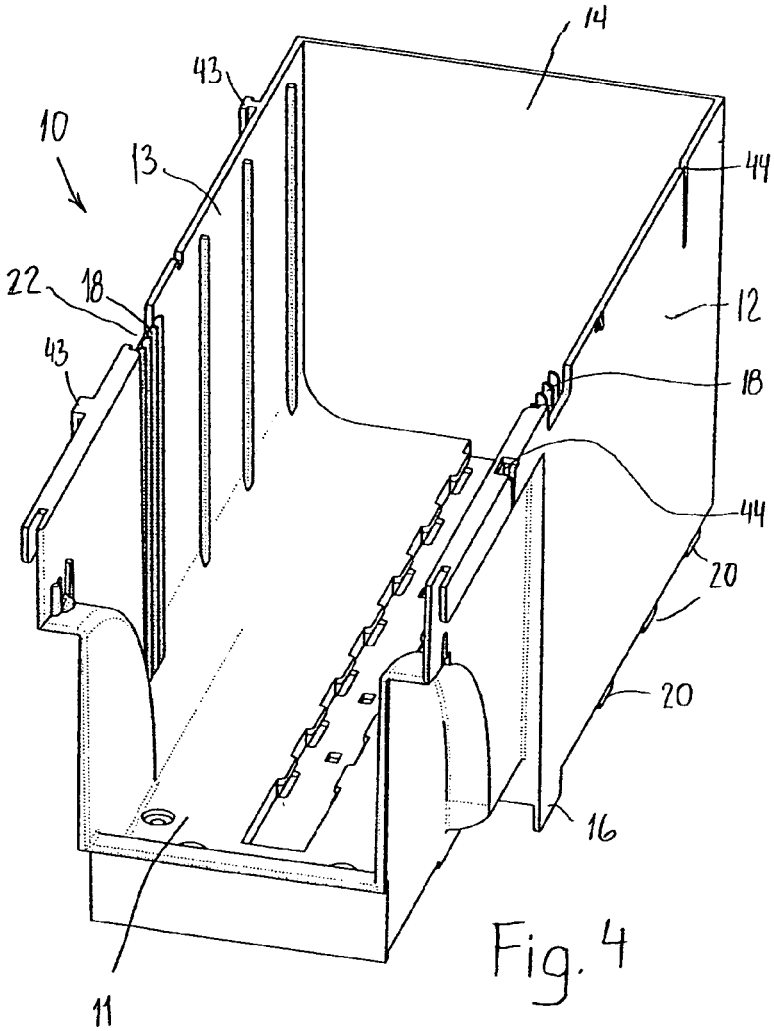
FIG. 4 is a perspective view of a bin of the system of FIG. 1.
Figure 5:
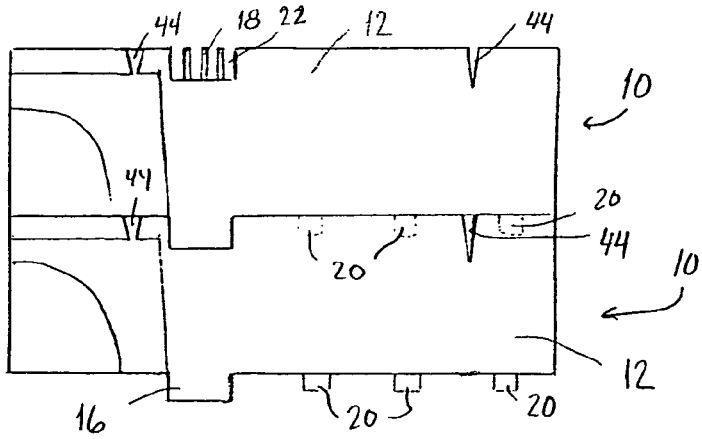
FIG. 5 is a side view of two stacked bins of the system of FIG. 1.

FIGS. 4 and 5 shown that each of the bins 10 has a bottom 11, a right side wall 12, a left side wall 13, and a rear wall 14. One flush projection 16 extends downward from each from the sidewalls 12, 13 and is flush with the outer sides of the sidewalls 12, 13. Three other projections 20 extend downward from the bottom 11 and are inwardly offset from the outer side of the sidewalls 12, 13. The flush projections 16 of the bottommost bin 10 in a stack or column are received in channels 259 in the bottom of the rack 250 or between the cross beams 154, 156 of rack 150 in which the bins 10 are arranged. The further projections 20 may each be received between further crossbeams. Alternatively, all three further projections may be received between two crossbeams. Each of the outer sides of the sidewalls 12, 13 also defines a recess 22 for receiving the projection 16 from a bin 10 stacked thereon (see FIG. 5). Ribs 18 extend upward from the inner side of the sidewalls 12, 13 in the area of the recesses 22 to provide a lateral support of the projection received in the recess 22. Although ribs 18 are shown in the preferred embodiment, an offset wall portion may alternatively be used to provide lateral support of the projection 16. The projections 20 are received on the inner sides of the respective sidewalls 12, 13. Although one projection 16 and three projections 20 are shown on each sidewall 12, 13, a bin having only one projection, such as, for example, projection 16 may be used to hold and position the bins 10 in a stack. The reception of the projection 16 in the recess 22 creates an interlocking connection which retains the upper bin in a defined lateral and longitudinal position relative to the lower bin. The additional projections 20 provide additional stability, especially in response to twisting movements of one bin on another.

Figure 6:
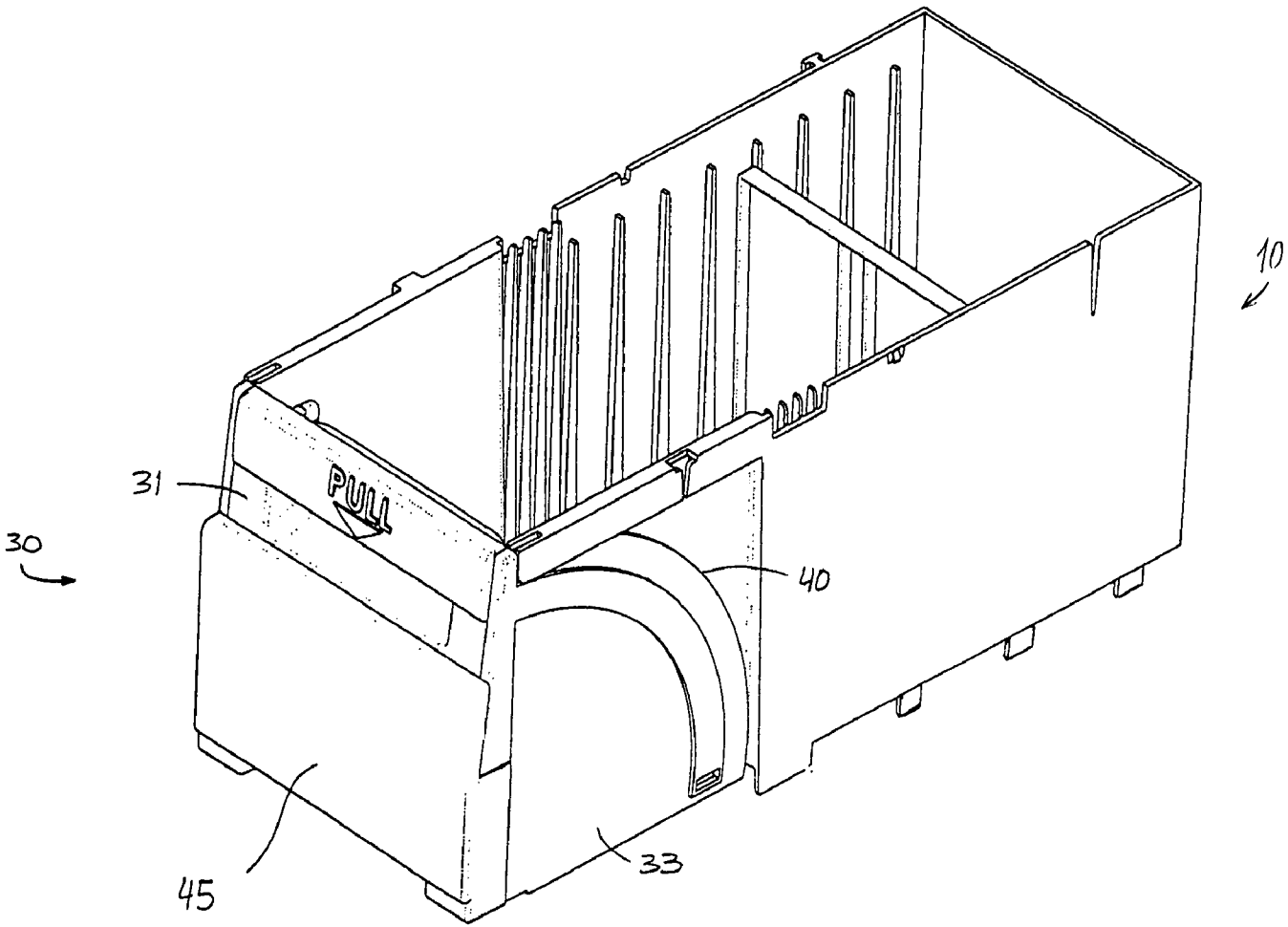
FIG. 6 is a perspective view of a bin having a door.
Figure 7:
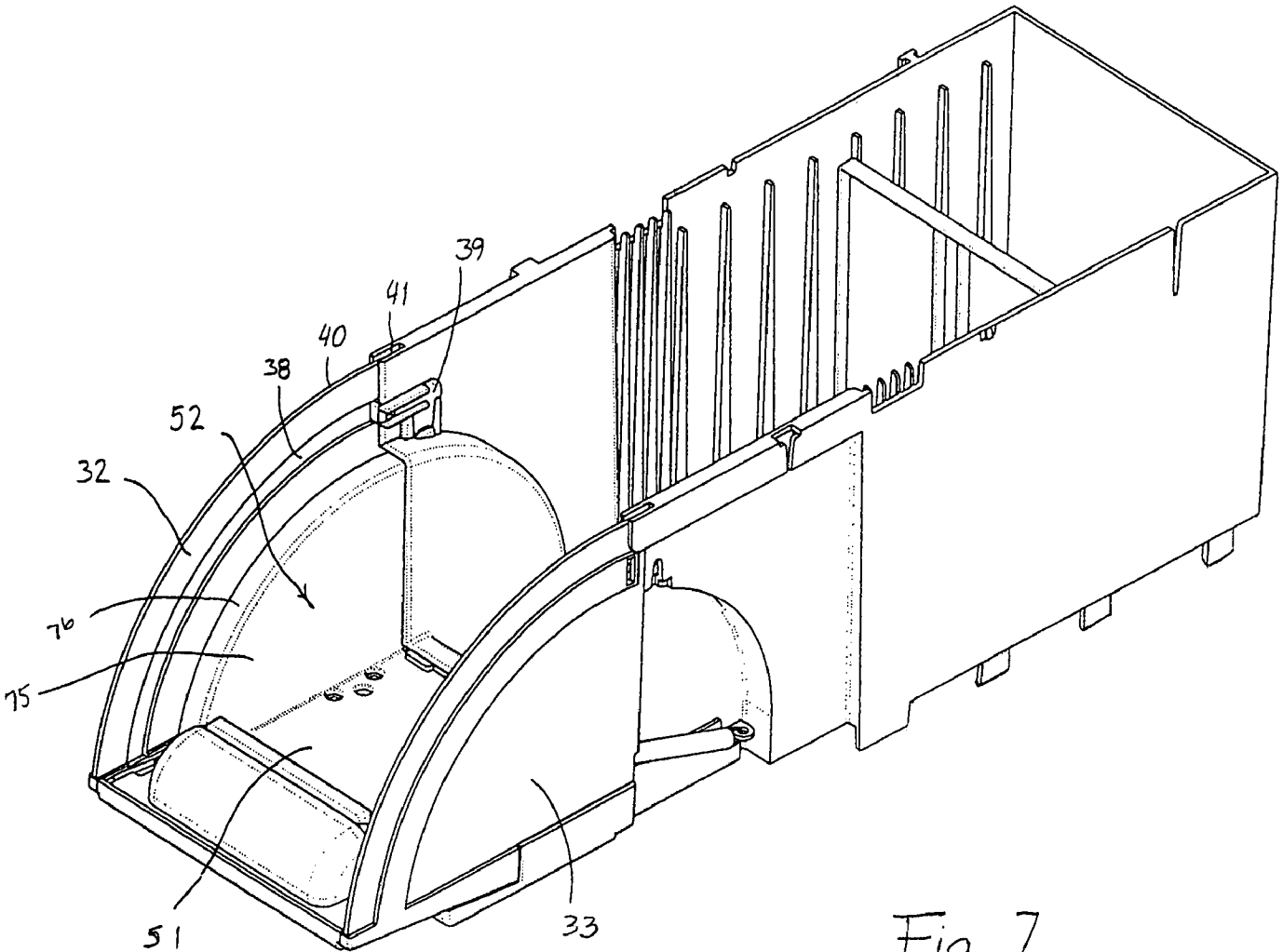
FIG. 7 is a perspective view of the bin of FIG. 6 in the open position.
Figure 8:
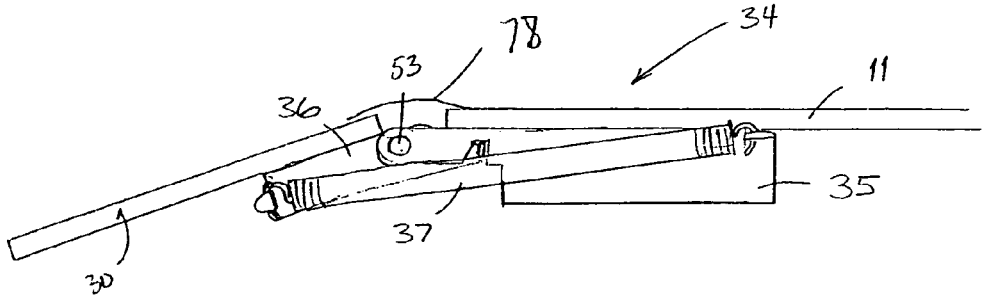
FIG. 8 is a side view of a hinge used for connecting the bin and door of FIGS. 6 and 7.

FIGS. 6 and 7 show a door 30 arranged at the front of the bin 10. The door 30 includes a front panel 31 and two side panels 32, 33 connected for example, by sonic welding, as a single unit. Alternatively, the front panel 31 and side panels 32, 33 may be connected by mechanical fasteners such as screws. The door 30 also includes a rear panel 51 which is described in more detail below. The door 30 is connected to the bin 10 by a hinge 34 (see FIG. 8) which pivots about an axis 53. Each hinge 34 includes a bin bracket 35 connected to the bin 10 and a door bracket 36 connected to the door 30. The bin bracket 35 and the door bracket 36 are pivotally connected to each other. A spring 37 is connected between the brackets 35, 36 so that an urgency from the spring 37 resiliently holds the door in a fully closed position. The spring 37 may be connected so that when the door is fully open, as in FIGS. 7 and 8, the spring 37 also resiliently holds the door 30 in the fully open position. This may be accomplished by designing the spring so that the furthest stretching point of the spring occurs between the fully open and fully closed position of the door 30. FIG. 8 is a schematic drawing showing an example of the door 30, the bottom 11 of the bin, and hinge 34 in the open position in which the spring 37 passes the furthest stretching point before reaching the fully open position.

The side panels 32, 33 of the door 30 each have a groove 38 facing the inside of the bin 10. A door retainer 39 is arranged at the front side of each sidewall 12, 13, the door retainer having a projection 39*a* which engages groove 38 of the respective side panel 32, 33. When the door 30 is fully open, the projections 39*a* of the door retainers 39 abut the longitudinal ends of the grooves 38, thereby preventing further opening movement of the door 30. A locking depression 55 may further be arranged at the longitudinal end of the groove to prevent the door 30 from being opened passed the fully opened position by overzealous use of the door 30. The radially outer edges 40 of the side walls 32, 33 furthest from the pivoting axis of the door 30 may be received in grooves 41 arranged in the sidewalls 12, 13 for guiding the opening and closing movement of the door 30. The interaction between the edges 40 and the grooves 41 may also retain the engagement between the groove 38 and retainers 39. The grooves 38 and retainers 39 may alternately be arranged on the outer sides of the side panels 32, 33. Furthermore, the groove may be arranged on the bin and the retainer arranged on the side panels.

Figure 9:
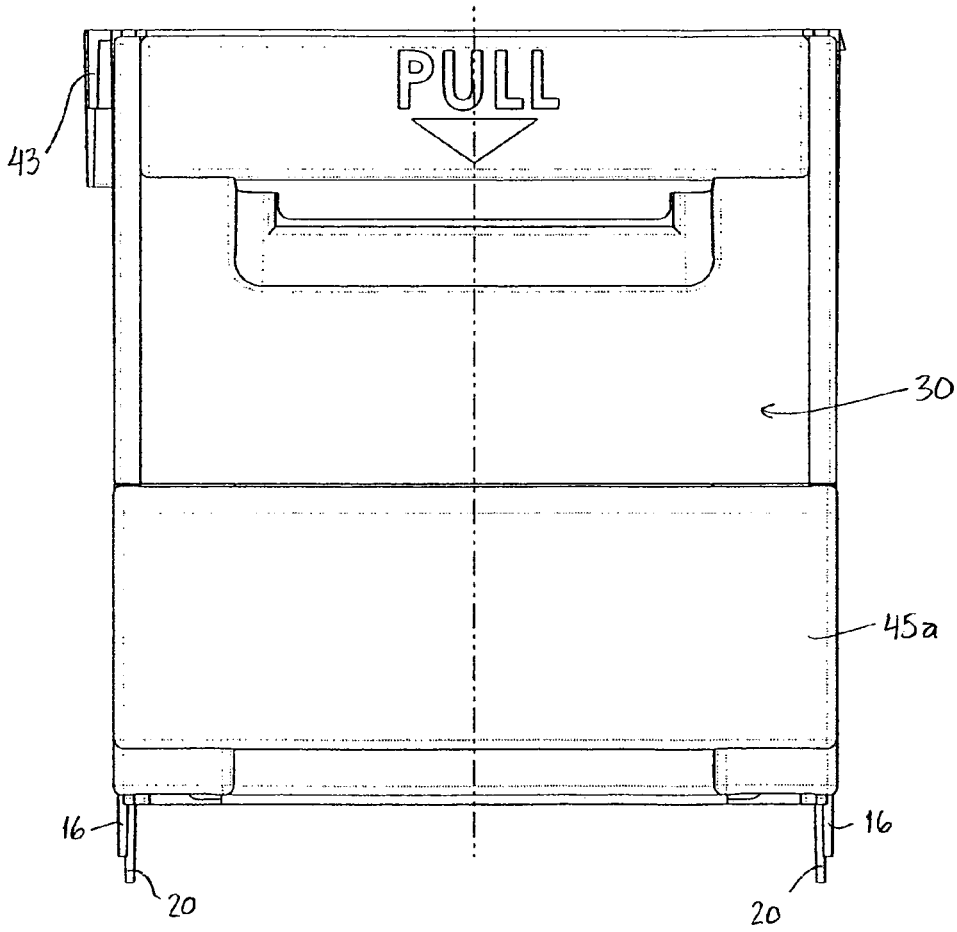
FIG. 9 is a front view of the bin of FIG. 6.

Each door 30 may include a product holder 45 as shown in FIG. 6. A sample of the product held in the bin may be connected to the product holder 45 using any conventional means such as, for example, retainer clips, threaded fasteners, wire, or adhesives. FIG. 6 shows a knob 46 for a drawer or cabinet mounted on the product holder 45. The product holder 45 is releasably connected to the door 30 so that it can be replaced if the product in the bin changes. The releasable connection may be a friction fit, retainer clip, threaded fastener. FIG. 9 shows a smaller product holder which may be used for smaller items such as nuts, bolts, and/or knobs. Instead of a door 30, the bin 10 may alternatively have a fixed front wall of approximately half the height of the bin. The fixed front wall may include the product holder 45 arranged on the bin using threaded fasteners, friction fit or retainer clip, or any other known or hereafter developed connection means.

The bin 10 and door 30 are preferably made of molded plastic. The brackets 35, 36 of the hinge are preferably made of metal. The product holder may also be made of plastic or a thin sheet of metal. Since the bin is intended to be used in large-scale home improvement stores, it will be subject to heavy use. Since it is difficult to replace a bin in the middle of an array of bins such as that shown in FIG. 1, the doors 30 may be designed to break before the bin 10. This may be accomplished by making the door panels of a slightly weaker structure than the bin, for example, by using a weaker material or designing the structure of the door to be weaker than that of the bin. Alternatively, connection of the hinge 34 to the door panel 30 may be made less strong than the connection of the hinge 34 to the bin 10.

Figure 10:
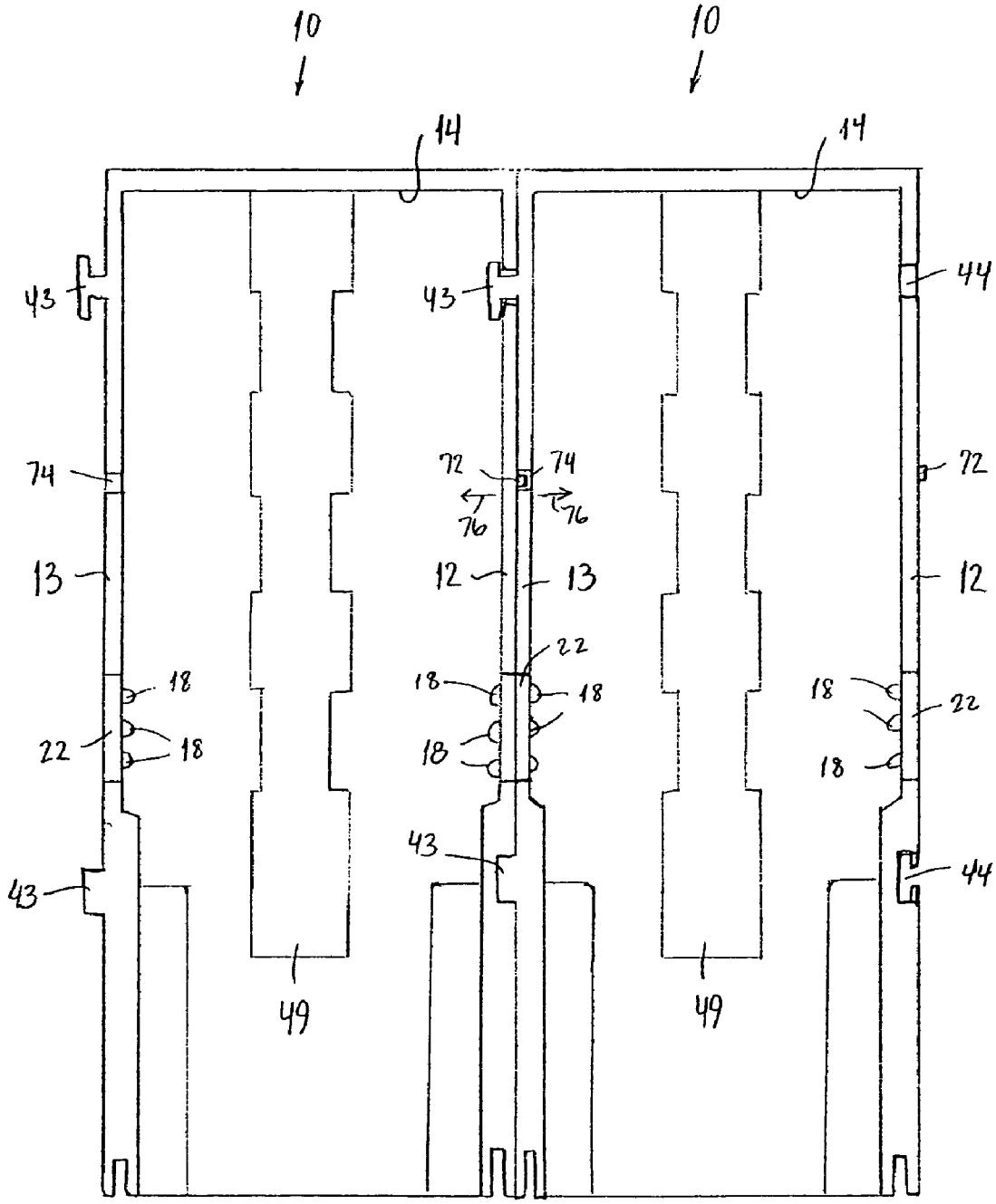
FIG. 10 is a plan view from above showing two laterally interlocked bins without doors.

As shown in FIGS. 4 and 9, each bin may further comprise a lateral retainer including a further projections 43 at one of the sides 12, 13 thereof which engages a slot or recess 44 (FIG. 4) on the other of the sides 12, 13 of a laterally adjacent bin. The lateral retainer holds adjacent columns of the array of bins together so that the entire system shown in FIG. 1 is held together as one unit. Two projections 43 are shown in the drawing. However, one or more projections 43 and corresponding slots or recesses 44 may be used to accomplish the retaining function. As shown in the drawings (FIG. 9), the further projection 43 faces downward and is arranged on the left side 13 of the bin 10 while the slot or recess 44 is arranged on the right side 12. Although a downward facing projection which simply slides into place is shown, other arrangements of projections could be used instead such as, for example, snap-fit projections. According to this embodiment, all projections 16, 20, and 43 engage simultaneously as a bin 10 is lowered onto the top of another bin. Since the projections 43 are arranged on the left side wall 13, each row of bins must be assembled left to right using the configuration shown in the drawings. FIG. 10 is a top view of two bins 10 arranged side by side showing the connection of the projections 43 and recesses 44. FIGS. 4, 9, and 10 also show a boss 72 arranged between the two recesses 44 projecting from the outer side of sidewall 12. When two bins are arranged side by side and the projections 43 and recesses 44 are engaged, this boss 72 is received in a recess 74 in sidewall 13. The interaction between the boss 72 and recess 74 acts as a latch which prevents the inadvertent removal of the bins from each other. The sidewalls 12, 13 are flexible such that disassembly of the bins is accomplished by spreading the two adjacent sidewalls 12, 13 away from each other (see arrows 76) until the interference between the boss 72 and the recess 74 is cleared. Since the bins 10 are interlocked with one another directly in both the vertical and horizontal directions and are self supporting, the bins may be arranged in racks of many different widths, heights, and depths.

Figure 11:
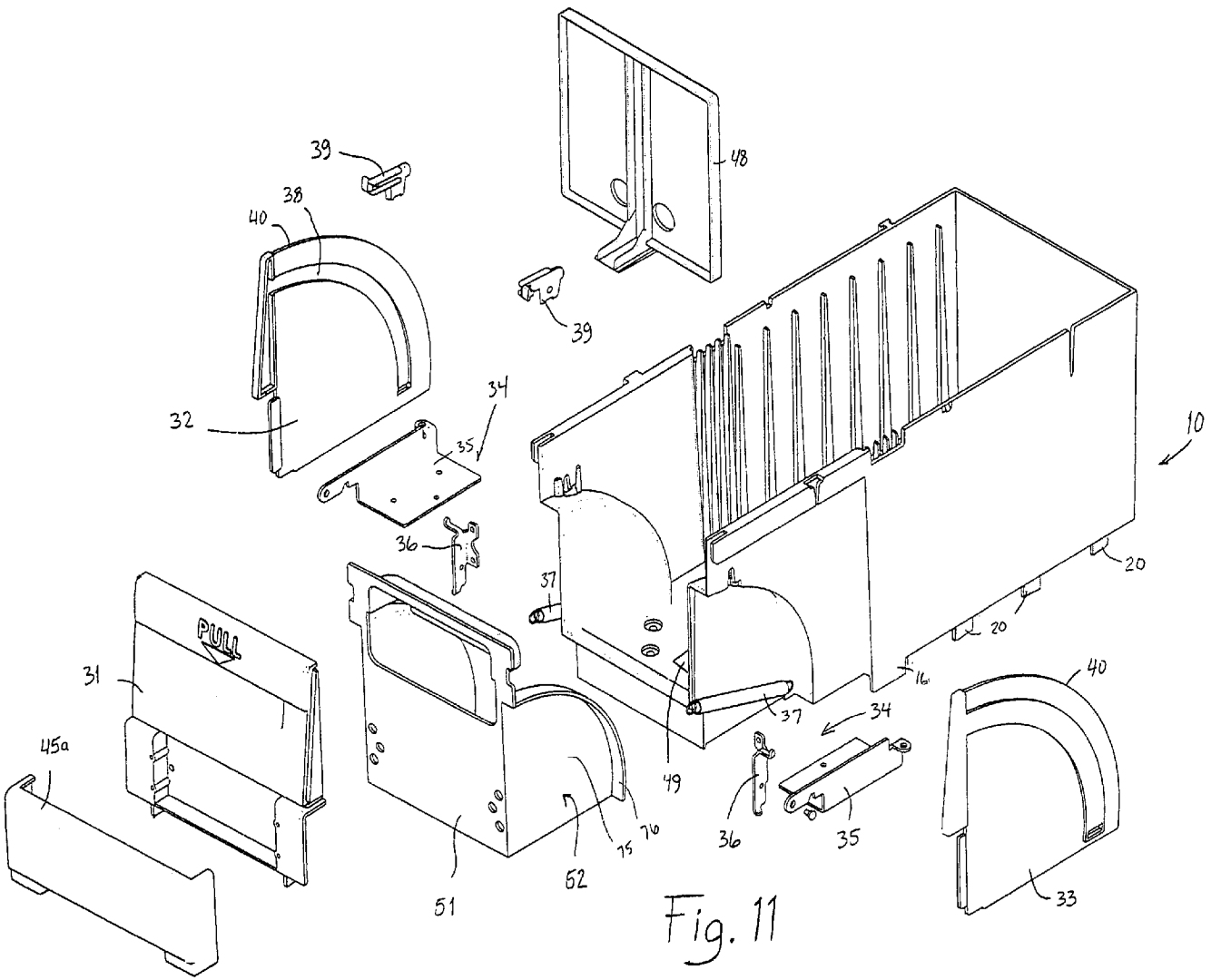
FIG. 11 is an exploded view of the bin of FIGS. 6 and 7.

FIG. 11 is an exploded view of the bin of FIGS. 5 and 6 and additionally shows an inventory control panel 48. The inventory control panel 48 is movably arranged in a track 49 on the bottom of the bin. The track may be dove-tail shaped or T-shaped to received a correspondingly shaped projection of the inventory control panel 48. The track 49 may also include resilient detents (not shown) arranged at a plurality of discrete locations for latching into recess 47 in the inventory control panel 48 and holding the inventory control panel 48 at one of a plurality of discrete locations along the track. The inventory control panel 48 is moved toward the front to keep the items in the bin toward the front. This is useful for small items and also where not many of a particular item are kept in stock.

FIGS. 7 and 11 show that the rear panel 51 of the door 30 includes spring covers 52 which project inward or away from the front panel 31 of door 30. The spring covers cooperate with the side panels 32, 33 to prevent access to the springs from inside the bin when the door 30 is opened. For this purpose, the spring cover 52 includes a first portion 75 arranged parallel to the side panel 32 or 33 and a second portion 76 which extends perpendicular to the first portion and closes that gap between the first portion 75 and the side panel 32 or 33. Both the first and second parts 75, 76 extend inward such that they extend to the bin when the door 30 is fully open, thereby preventing the products or other debris from entering the area in which the spring is mounted, see e.g., FIG. 7.

A further gap to be protected is the gap between the door 30 and the bin 10 when the door is open. For this purpose, a flexible protective covering 78 may be connected between the front end of the bin and the bottom of the door 30 as shown schematically in FIG. 8. The protective covering 78 may comprise a plastic or a thin metal sheet, or any other known or hereafter developed material which is sufficiently flexible to allow door pivoting motion and sufficiently strong to prevent products or other debris from entering the gap between the door and the bin.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A bin system for holding products and interlocking with another bin, comprising:

at least one support arranged on one of a floor and a frame having a longitudinal length configured to accept at least one bin, the at least one support comprising:

a horizontal center portion having a mating surface for receiving the at least one bin; and first and second vertically extending walls arranged at each longitudinal edge of the horizontal center portion, the first and second vertically extending walls extending substantially perpendicularly away from the mating surface; and engagement means arranged on the mating surface; and the bin comprising:

a housing having a front end, a rear end, a top and a bottom, and including a bottom section, side walls, and a rear wall defining a space for holding products, said housing having first vertically extending interlocking means in said bottom section and second interlocking means on a top of at least one of said sidewalls configured to vertically receive and mate with said first interlocking means;

mounting means projecting from said bottom section and configured to engage the at least one support connected to one of a floor or a support frame, the mounting means configured to mate with the engagement means;

a door pivotably arranged at said front end of said housing and being pivotal between a fully open position providing access to said space from said front end and a fully closed position preventing access to said space through said front end; and a spring arranged between said door and said housing and dimensioned such that an urgency of said spring resiliently holds said door in said fully closed position, wherein said second interlocking means is capable of receiving said first interlocking means such that said bin is capable of interlockedly receiving the another bin from above, when the another bin has said first interlocking means, said first and second interlocking means being arranged and dimensioned for preventing longitudinal and lateral movement between said first and second interlocking means when said first interlocking means is engaged with said second interlocking means.

2. The bin of claim 1, wherein said spring is also arranged and dimensioned for resiliently holding said door in the fully open position.

3. The bin of claim 2, wherein said greatest extension of said spring occurs between said fully open position and said fully closed position.

4. The bin of claim 1, wherein said door comprises spring enclosure panels for preventing access to said springs from the front end of said housing when the door is open.

5. The bin of claim 1, wherein said first interlocking means comprises a first projection extending downward from each lateral side of said bottom section and said second interlocking means comprises a recess in a top of each of said sidewalls.

6. The bin of claim 5, further comprising stops connected to an inner side of said sidewalls, extending upward and defining inner sides of said recesses.

7. The bin of claim 6, wherein said stops comprise ribs extending substantially vertically on said inner sides of said sidewalls.

8. The bin of claim 5, further comprising an additional projection rearward of each first projection and offset from said sidewalls such that said additional projections interact with inner sides of the another bin when the another bin is arranged below said bin.

9. The bin of claim 1, further comprising third interlocking means on one of said sidewalls and fourth interlocking means on the other one of said sidewalls, said fourth interlocking means capable of engaging said third interlocking means of the another bin when the another bin is laterally adjacent said bin.

10. The bin of claim 9, further comprising a boss on said other one of said sidewalls and a further recess on said one of said sidewalls, wherein an interaction between said boss and said further recess of the another bin when said third and fourth interlocking means are engaged preventing release of the another bin from said bin.

11. The bin of claim 1, wherein a sample of the product in said bin is connected to a front of said door.

12. The bin of claim 1, further comprising a product control panel dividing said space into two spaces and movably arranged in a longitudinal track defined in said bottom section of said housing for changing a size of the usable space between said door and said product control panel.

13. A bin system, comprising:

a bin support including at least two crossbeams extending substantially parallel, each crossbeam configured as a hat rail comprising:

a horizontal center portion having a mating surface for receiving the at least one bin;

first and second vertically extending walls arranged at each longitudinal edge of the horizontal center portion, the first and second vertically extending walls extending substantially perpendicularly away from the mating surface; and at least one engagement means arranged on the mating surface; and a plurality of bins arranged on said bin support in at least one interlocked stack, wherein each of said bins comprises a housing having a bottom section, sidewalls and a rear wall defining a space for holding products, said housing having first vertically extending interlocking means in said bottom section and second interlocking means configured to vertically engage the first vertically extending interlocking means on a top of at least one of said sidewalls engaging the first interlocking means of a directly vertically adjacent bin, the engagement of said first and second interlocking means preventing at least horizontal movement in lateral and longitudinal directions of said bin, and wherein mounting means of the lowermost bin of each stack of bins being received between and engaged with said at least two crossbeams and the at least one engagement means of said bin support.

14. The system of claim 13, wherein said bin support is built into a rack having at least one row of vertical posts.

15. The system of claim 14, further comprising a bin cover arranged over the uppermost bin of said at least one stack and connected to said at least one row of vertical posts.

16. The system of claim 13, further comprising crossbeam supports arranged under said crossbeams and extending substantially perpendicular to said crossbeams.

17. The system of claim 13, wherein each of said bins comprises:

a door pivotably arranged at said front end of said housing and being pivotal between a fully open position providing access to said space from said front end and a fully closed position preventing access to said space through said front end; and a spring arranged between said door and said housing and dimensioned such that an urgency of said spring resiliently holds said door in said fully closed position.

18. The system of claim 17, wherein said spring is also arranged and dimensioned for resiliently holding said door in the fully open position.

19. The system of claim 18, wherein said greatest extension of said spring occurs between said fully open position and said fully closed position.

20. The system of claim 17, wherein said door comprises spring enclosure panels for preventing access to said springs from the front end of said housing when the door is open.

21. The system of claim 13, wherein said first interlocking means comprises a first projection extending downward from each lateral side of said bottom section and said second interlocking means comprises a recess in a top of each of said sidewalls.

22. The system of claim 21, wherein each of said bins further comprises stops connected to an inner side of said sidewalls and extending upward for defining inner sides of said recesses.

23. The bin of claim 22, wherein said stops comprise ribs extending substantially vertically on said inner sides of said sidewalls.

24. The system of claim 21, further comprising an additional projection rearward of each first projection and offset from said sidewalls such that said additional projections interact with inner sides of the another bin when the another bin is arranged below said bin.

25. The system of claim 13, further comprising third interlocking means on one of said sidewalls and fourth interlocking means on the other one of said sidewalls, said fourth interlocking means capable of engaging said third interlocking means of a laterally adjacent bin.

26. The system of claim 25, further comprising a boss on said other one of said sidewalls and a further recess on said one of said sidewalls, wherein an interaction between said boss and said further recess provides a snap fit which prevents release of the engagement of said third and fourth interlocking means.

27. The system of claim 13, wherein said bin support is connected to one of a floor beneath said bin system and a support frame.

28. The bin of claim 1, wherein the first vertically extending interlocking means and the mounting means are arranged with a horizontal spacing substantially equal to a thickness of the side wall.

29. The bin of claim 13, wherein the first vertically extending interlocking means and the mounting means are arranged with a horizontal spacing substantially equal to a thickness of the side wall.

* * * * *